US007954413B2

(12) United States Patent
Koth

(10) Patent No.: US 7,954,413 B2
(45) Date of Patent: Jun. 7, 2011

(54) TWO-STAGE LIGHT GAS GUN

(76) Inventor: Philip Edward Koth, East Peoria, IL (US)

( * ) Notice: Subject to any disclaimer, the term of this patent is extended or adjusted under 35 U.S.C. 154(b) by 1084 days.

(21) Appl. No.: 11/787,776

(22) Filed: Apr. 18, 2007

(65) Prior Publication Data

US 2010/0212481 A1 Aug. 26, 2010

(51) Int. Cl.
*F41A 1/04* (2006.01)

(52) U.S. Cl. ..... 89/7

(58) Field of Classification Search ..... 89/7
See application file for complete search history.

(56) References Cited

U.S. PATENT DOCUMENTS 1,183,644 A * 5/1916 Hill ..... 124/75
2,872,846 A * 2/1959 Crozier ..... 89/7
2,882,796 A 4/1959 Clark et al.
3,326,084 A * 6/1967 Barbieri et al. ..... 89/7
4,038,903 A 8/1977 Wohlford
4,077,147 A * 3/1978 Donnard et al. ..... 42/1.14
4,603,615 A * 8/1986 Ashley ..... 89/7
4,658,699 A * 4/1987 Dahm ..... 89/8
4,664,631 A * 5/1987 Pederson et al. ..... 434/16
4,833,961 A * 5/1989 Adini ..... 89/1.1
5,194,690 A * 3/1993 Guthrie et al. ..... 102/440
5,650,585 A * 7/1997 Pate et al. ..... 89/7

OTHER PUBLICATIONS

NACA (National Advisory Committee for Aeronautics) technical note 4143, "Development of a Piston-Compressor Type Light-Gas Gun . . . ", by Charters et al, Nov. 1957.
Aviation Week and Space Technology, "World's Largest Light Gas Gun Nears Completion at Livermore", Aug. 10, 1992, pp. 57-59, vol. 137, Issue #6.
NASA Contractor Report 4491, "Concept Definition Study for an Extremely Large Aerophysics Range Facility", by Hallock F. Swift, Feb. 1993.

* cited by examiner

*Primary Examiner* — Stephen M Johnson

(57) ABSTRACT

An improved two-stage light gas gun for launching projectiles at high speeds. The gun consists of three tubes: the expansion, pump, and launch tubes. The expansion tube contains a close-fitting expansion piston that is propelled by an explosive charge. The expansion piston in turn drives the pump piston housed within the pump tube by means of a rod connecting the two pistons. The action of the pump piston adiabatically compresses and heats a light gas of hydrogen or helium, bursting a diaphragm at a predetermined pressure and expelling the projectile from the launch tube at a very high speed.

13 Claims, 7 Drawing Sheets

TWO-STAGE LIGHT GAS GUN

CROSS REFERENCE TO RELATED APPLICATIONS

None

FEDERALLY SPONSORED RESEARCH

None

SEQUENCE LISTING

None

BACKGROUND OF THE INVENTION

1. Field of the Invention

This invention relates to a type of gun known as a two-stage light gas gun, which is designed to fire projectiles at very high speeds.

2. Background of the Invention

A light gas gun is designed to shoot projectiles at very high speeds by utilizing a high-pressure gas of low atomic number, typically either hydrogen or helium. Used extensively for research involving hypervelocity projectiles, the use of light gases as a propelling medium has produced projectile speeds up to several times greater than the highest speed attained by guns utilizing conventional propellants such as modern gunpowders.

In the prior art there exists various designs of light gas guns that can generally be categorized as being of one-stage, two-stage, or three-stage design. All three types of light gas gun designs are capable of firing projectiles at hypervelocity speeds. The object of this invention relates to the two-stage design. It should be mentioned that another type of hypervelocity gun appearing in the prior art is the shock wave gun, which in some embodiments takes the form of a special type of two-stage light gas gun.

In the two-stage light gas gun design, either hydrogen or helium gas is initially held within a so-called pump tube. Within the pump tube is a piston called the pump piston that is used to compress the light gas. Rigidly connected to one end of the pump tube is a so-called launch tube that holds a projectile to be launched. An explosive charge, such as gunpowder or a fuel/air mixture, lies on one side of the pump piston. On the other side of the piston is the light gas along with a diaphragm that initially prevents the light gas from flowing from the pump tube into the launch tube. The diaphragm, which is placed near the junction of the pump and launch tubes, is a type of one-use valve that is designed to burst open at a preset pressure. When the explosive charge is ignited it causes the piston to accelerate towards the diaphragm, an action that quickly compresses the hydrogen (or helium). When the piston has compressed the light gas to a predetermined pressure, the diaphragm bursts open. The high-pressure, hot hydrogen (or helium) pours through the burst diaphragm and into the launch tube, which in turn causes the projectile to be expelled from the launch tube's muzzle. The launch tube is typically several times smaller in diameter than the pump tube. The pump and launch tubes together form the overall length of a conventional two-stage light gas gun.

In the NACA technical note 4143 by Charters et al (1957) a two-stage light gas gun is described that contains a pump piston as well as a heavier secondary piston called a valve piston. After ignition of the powder charge, the pump piston and valve piston are driven in opposite directions along the length of the pump tube. The movement of the heavy valve piston allows the delayed release of hot propellant gases from the pump tube. The pump piston is designed to 'bounce back' after the diaphragm is ruptured, preventing it from ramming into the end of the pump tube, which could possibly damage the gun. In spite of its positive features, this design has several drawbacks. First, between firings the gun must be partially disassembled in order to return the pump and valve pistons to the firing position. Another drawback is the residue—such as a carbon buildup—that forms due to the repeated use of a solid propellant in the pump tube, which must periodically be cleaned out. Another disadvantage is that the pump tube must be lengthened in order to accommodate the rearward movement of the valve piston. A final drawback is that a danger exists that if too much propellant is used, or an insufficient quantity of light gas is present before firing, that the freely-moving pump piston will collide with the end of the pump tube, leading to damage of the piston, the pump tube, or both.

In U.S. Pat. No. 2,872,846 Crozier (1959) shows an alternative embodiment that is basically identical to the Charters (1957) design described above, except that Charters' valve piston, whose action allows leftover propellant to escape the pump tube, is absent. The simpler design, however, leads to its first drawback: there is no provision for the automatic and convenient venting of propellant gases once the gun has been fired. Other than that difference, Crozier's design has several distinct disadvantages in common with Charters' design. First, a danger exists that if too much propellant is used, or an insufficient quantity of light gas is present before firing, the pump piston will collide with the end of the pump tube, leading to damage of the piston, the pump tube, or both. Second, between firings the gun must be partially disassembled in order to return the pump piston to the firing position. Third, due to the repeated use of a solid propellant in the pump tube, residue forms that periodically must be cleaned out.

In contrast to the design of Charters et al (1957) summarized above in which the pump piston bounces back from the end of the pump tube, U.S. Pat. No. 2,882,796 to Clark et al (1959) describes a pump piston designed to purposely ram into the diaphragm-end of the pump tube. The pump piston is made of a material—such as nylon—that is readily deformable under high pressures. This design has the advantage that it eliminates the concern of damage to the pump tube by the pump piston, since the pump piston is specifically design to impact and then squeeze into the constriction of the pump tube that leads into the launch tube. However, there are distinct disadvantages of this design: 1) as in the Crozier (1959) design described previously, there is no mechanism provided to automatically vent the remaining propellant gases once the gun has been fired; 2) the pump tube must be opened up so that the tightly squeezed compression piston can be extricated, considerably slowing the process of preparing the gun for another firing; 3) after each firing, residue from the propellant can contaminate the interior of the pump tube; and 4) after each firing the old pump piston is severely distorted and must be discarded, while a new pump piston must be loaded into the pump tube. Discarding the pump piston after each shot increases costs as compared to a pump piston that can be reused repeatedly.

In U.S. Pat. No. 4,038,903 Wohlford (1977) describes a telescoped two-stage light gas gun. The telescoped gun was intended as an anti-aircraft weapon, its design permitting a higher rate of fire as compared with previous two-stage light gas gun designs. The gun is designed so that the pump piston and launch tube always move together as a single, ridged unit.

One favorable feature of the gun is that the area of the pump piston that the propellant gas pushes against is greater than the area of the pump piston that compresses the light gas; unfortunately, the ratio of propellant area to compression area is not very high, being only fractionally higher than unity, i.e., much closer to a ratio of 1 than to a ratio approaching 2 or more. In spite of a few favorable features, the telescoped design suffers from a number of drawbacks: 1) in order for there to be a good seal between the outside of the gun barrel and the inside of the pump tube opening, not only must the inside of the gun barrel be machined to a high degree of precision (which is normally the case for most gun barrels), but also both the outside of the gun barrel and the inside of the pump tube opening must be machined very close to round as well. However, repeated firing of the weapon will heat its various parts. If the gun barrel is heated more or less than the pump tube, the expansion of the two parts will also vary, which could lead to either significant loss of gas at the pump tube/launch tube seal, or to increased friction at the same seal thereby slowing the motion of the pump piston; (2) this design allows propellant residue to form on both the inside of the pump tube and the outside of the launch tube, which can lead to increased wear of those parts, as well as the need for frequent cleanings of those same parts; (3) after a projectile is fired from the gun, the reloading of another projectile is overly complicated. First the rear of the pump tube must be opened, and then the rear of the launch tube must be opened as well. After the projectile (and possibly a diaphragm) is loaded, first the launch tube must be closed, followed by closure of the pump tube. Such a procedure takes an inordinate amount of time for a gun designed to be a weapon; (5) if too little light gas is introduced into the pump tube, then the pump tube piston might violently collide with the end of the pump tube housing, damaging or destroying the gun; and (6) in the telescoped gun design, the breach end of the launch tube is rigidly connected to the pump piston. That pump piston/launch tube connection is riddled with holes that allow the hot, compressed light gas to enter from the pump tube. Such a design is structurally much weaker than in other light gas gun designs, wherein there is a simple transition from the pump tube into the launch tube, and said transition of the two tubes is very strong because it is encased within a large block of metal.

In U.S. Pat. No. 4,658,699 Dahm (1987) describes a two-stage light gas gun referred to as a 'wave gun'. The wave gun uses a light and flexible pump piston that—after the projectile has exited the launch tube—is forced through the pump tube/launch tube constriction, and then travels through and out the launch tube. Higher muzzle velocities of the projectile are claimed for this design, as compared to other two-stage light gas guns. The design, however, is beset by a variety of drawbacks: (1) expulsion of the light piston entirely from the gun means that propellant residue contaminates not only the pump tube, but the launch tube as well; (2) the mechanical integrity of the pump piston is questionable because it is designed to travel back and forth within the pump tube several times before finally being expelled from the gun. Such a 'wave' motion with the hot, high-pressure propellant gas on one side and the hot, high-pressure light gas on its other side would put enormous stresses on such a light and deformable piston, which could well lead to a blow-by of the propellant and/or light gases and subsequent contamination of the light gas with propellant, which in turn would degrade the interior ballistic performance of the projectile; (3) increased erosion of the launch tube interior. High velocity light gas guns have traditionally suffered from erosion of the launch tube after each firing of the gun. But the wave gun not only expels the projectile and associated light gas from the launch tube, but the pump piston and the propellant as well. The additional material ejected through the launch tube at high speeds would probably increase launch barrel erosion significantly as compared to more conventional designs; and (4) a final drawback of the wave gun design is that if all or part of the deformable pump piston does not completely leave the launch tube, its presence could impede a subsequent firing with potentially catastrophic damage to the gun.

In the article titled "World's Largest Light Gas Gun Nears Completion at Livermore" appearing in Aviation Week and Space Technology/Aug. 10, 1992/pp 57-59, a two-stage light gas gun designed by John Hunter uses a methane/air mixture as the propellant to accelerate a heavy steel piston down a long pump tube to compress the light gas. The pump tube is at a right angle to the launch tube. Shock absorbers negate the recoil transmitted through both the pump and launch tubes. The pump and launch tubes are connected in such a way that the launch tube can be swiveled to any angle from horizontal up to vertical. A positive feature of Hunter's design is that it uses a clean-burning and inexpensive propellant source. However, the design possesses a number of disadvantages: (1) the pump tube is excessively long compared to the launch tube length; indeed, the prototype that was constructed had a pump tube nearly twice as long as the launch tube. Such a long pump tube makes for an unwieldy design, and means a much more expensive gun; (2) a right angle between the pump and launch tubes leads to large torques on each tube that are eliminated with shock absorbers, which increases complexity and the total cost of the gun. Moreover, failure of a shock absorber could lead to severe damage of the gun, especially in the vicinity where the pump and launch tubes meet; (3) even though methane is typically very clean burning as compared to, say, gunpowder, if the combustion of methane is not complete, carbon deposits could still form in the pump tube; (4) after the gun is fired the freely-moving, heavy pump piston must be returned the length of the long pump tube before another firing can take place, slowing the time between firings; and (5) the swivel connection between the pump and launch tubes, which allows a projectile is to be fired at various angles, must be made of very strong materials and to very close tolerances so that no leakage of hot gases occurs, which all translates into a significant increase in the cost of the gun.

In NASA Contractor Report 4491 titled "Concept Definition Study for an Extremely Large Aerophysics Range Facility" by Hallock F. Swift, dated February 1993, a two-stage light gas gun is proposed that foregoes the use of a combustible propellant to propel the pump piston, using instead helium compressed to 15,000 pounds per square inch. The helium is held within high-pressure storage tanks until it is quickly released into the pump tube, at which time the highly compressed helium accelerates a large and heavy pump piston down the pump tube, compressing low-pressure helium on the opposite side of the pump piston, which in turn launches the projectile from the launch tube.

A prominent feature of the proposed light gas gun is that no propellant residue should form in the pump tube since the propelling gas—namely helium—is non-combustible. In spite of that advantageous characteristic, the design has a number of other features that are decidedly disadvantageous: first, the pump piston is partially deformed on each shot, and must be either discarded completely, or repaired for subsequent use, and either option translates into increased cost per shot from the gun; second, at the end of each firing the pump tube must be opened and a device inserted in order to retrieve the used pump piston, a procedure which considerably slows the process of readying the gun for another firing; third, helium used as the propelling gas of the pump piston is rather expensive; therefore, the design calls for reuse of the helium, which entails pumping it from the pump tube back into the original storage tanks; the reuse of the helium increases the complexity of the entire gun system, and greatly delays the possible time between firings; the author cites a ballpark figure of around an hour to recompress the helium; while higher-capacity pumps could certainly decrease the time needed to recompress the helium, the higher initial and ongoing costs associated with their use would also significantly increase the overall cost of the entire system.

As demonstrated above, there are many different designs of two-stage light gas guns known in the prior art. Each design possesses various strengths and weaknesses, some of which were outlined above; however, the designs known heretofore all suffer from a number of drawbacks:

(a) after the gun is fired, the pump piston cannot be quickly returned to its original start position for another firing of the gun;

(b) the length of time to reload the gun with a projectile is excessive;

(c) in the prior art a number of different types of gases have been used to propel a pump piston down the length of a pump tube, but under the right conditions any type of propelling gas is capable of leaving residues within the pump tube that build up over repeated firings of the gun;

(d) after the gun is fired, the spent propellant gas is expelled either through the use of some type of valve integrated into the pump tube, which adds cost and complexity to the gun design, or by exiting through the launch tube, which can foul the launch tube with propellant residue and/or increase interior erosion;

(e) the area of the pump piston the propelling gas pushes against versus the area of the pump piston that compresses the light gas is restricted in all previous designs known heretofore, and that restriction limits the utility of those designs; specifically, most designs in the prior art set the area of the pump piston that the propelling gas pushes against equal to the area of the pump piston compressing the light gas; but at least one design results in a ratio of propelling area to compression area slightly greater than 1; however, no known previous design allows a broad range of ratios.

(f) no design known heretofore is easily adapted to a variety of roles; a design that is well-suited for laboratory research is unwieldy when applied to a military role or space launch applications, and vice versa;

BACKGROUND OF INVENTION

Objects and Advantages

Several objects and advantages of my invention are:

(a) to provide a two-stage light gas gun in which the pump piston can quickly be returned to its start position for another firing;

(b) to provide a two-stage light gas gun that can be quickly reloaded with a projectile for a subsequent firing of the gun;

(c) to provide a two-stage light gas gun that prevents any possible residue from the gas propelling the pump piston from contaminating either the pump or launch tubes;

(d) to provide a two-stage light gas gun in which the gas propelling the pump piston is quickly and automatically vented without the need for valves;

(e) to provide a variety of possible ratios, from less than one, to equal to one, to greater than one, of the area of the piston the propelling gas pushes against versus the area of the pump piston compressing the light gas;

(f) to provide a two-stage light gas gun design that performs well in a variety of roles: laboratory research, anti-armor, very long-range artillery, and shots into outer space.

Further objects and advantages are to provide a two-stage light gas gun in which the pump piston can be halted reliably at a predetermined position within the pump tube, which can utilize inexpensive and clean-burning propellants—such as an alcohol/air mixture—without the need for an excessively long pump tube, which can use the spent propellant gas to counteract the recoil due to firing the gun, which does not deform the pump piston as part of the gun's firing cycle, which provides for a pump tube that is considerably shorter than the launch tube, and in which the projectile can be loaded into the gun via a conventional breech block. Still further objects and advantages of my invention will become apparent upon consideration of the drawings and ensuing description.

SUMMARY

In accordance with the present invention an improved two-stage light gas gun for launching projectiles at very high speeds, and consisting of three main parts: a launch tube from which a projectile is fired; a pump tube filled with pressurized hydrogen or helium; and an expansion tube containing a propellant charge. When the propellant charge is ignited a piston in the expansion tube is driven forward and pushes on a piston in the pump tube, compressing the hydrogen or helium, which in turn expels the projectile from the launch tube at high speed.

DRAWINGS

Figures

In the drawings, closely related figures are identified by the same number but with different alphabetic suffixes.

DETAILED DESCRIPTION

Figure 1:
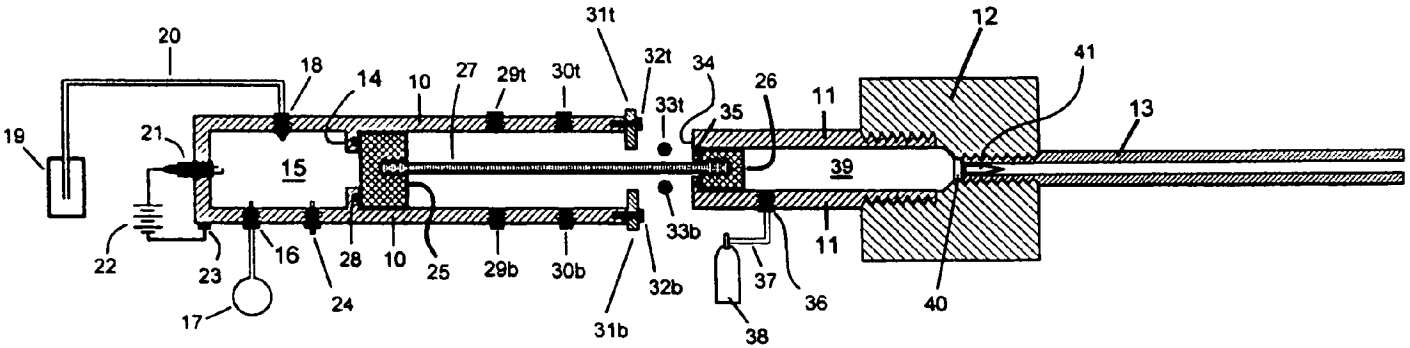
FIG. 1 shows a lateral cross-sectional view of the preferred embodiment of a two-stage light gas gun constructed in accordance with the present invention.
Figure 2:
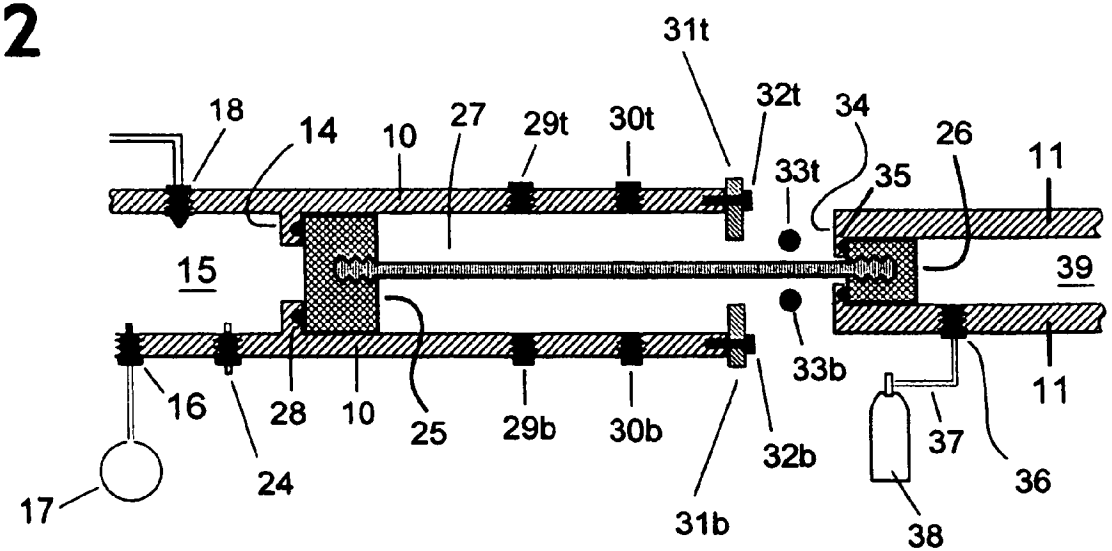
FIG. 2 shows a magnified view of a more-or-less central portion of FIG. 1.

FIGS. 1 and 2—Preferred Embodiment

A preferred embodiment of the two-stage light gas gun of the present invention is depicted in FIG. 1, which is of a lateral, cross-sectional view. FIG. 2 shows a magnified portion of FIG. 1. The gun can conveniently be divided into four segments: the expansion tube 10, pump tube 11, connecting block 12, and launch tube 13. The four main segments of the gun are made out of any suitable material typically employed in producing guns, such as high strength steel. Materials lighter than steel, such as titanium, or metal matrix composites, can also be employed if their tensile and compressive strengths are adequate for the role.

A shoulder 14 near the middle of expansion tube 10 defines combustion region 15. A one-way valve 16 allows an oxidizing gas, such as air, nitrous oxide, or pure oxygen, to flow into combustion chamber 15 but prevents it from passing back out. The gas is supplied from a pump or pressurized tank 17 that is connected to one-way valve 16.

Fuel injector 18 is connected to fuel tank 19 by fuel line 20, which may be of either rigid or flexible construction. Spark plug 21 is connected to power supply 22, which is grounded to expansion tube 10 by metallic bolt 23. Pressure relief valve 24 opens automatically if the pressure inside combustion chamber 15 exceeds a predetermined safe value; valve 24 can also be opened manually.

Within expansion tube 10 is expansion piston 25, which is connected to smaller pump piston 26 within pump tube 11 by connecting rod 27. On the piston side of shoulder 14 is o-ring 28. Expansion tube 10 has the four removable plugs 29*t* ("t" stands for "top"), 29*b* ("b" stands for "bottom"), 30*t*, and 30*b*. At one end of expansion tube 10, at the end opposite combustion chamber 15, are end-stops 31*t* and 31*b*, held in place by bolts 32*t* and 32*b*, respectively.

Situated between expansion tube 10 and pump tube 11 are return rollers 33*t* and 33*b*. At one end of pump tube 11 is end cap 34, the inside face of which holds o-ring 35. One-way valve 36 allows a light gas, either hydrogen or helium, to flow into cavity 39 defined by pump tube 11, but prevents the light gas from flowing back out. Pressure tank 38 contains a light gas and is connected by high-pressure line 37 to one-way valve 36. Connecting block 12 holds diaphragm 40. Projectile 41 lies within launch tube 13 and adjacent to diaphragm 40.

Operation

FIGS. 1, 3A-3F

Operation of the two-stage light gas gun that is the object of this invention begins with unscrewing launch tube 13 from connecting block 12 and loading diaphragm 40 and projectile 41 (FIG. 1). Diaphragm 40 may be held in place by any convenient means, such as a slight taper of its outer surface, along with a corresponding taper of the inner portion of connecting block 12 where diaphragm 40 fits (said taper is not represented in FIG. 1). Plugs 30*t* and 30*b* have been removed as shown in FIGS. 3A through 3F in order to allow the venting of the spent propellant gas; plugs 29*t* and 29*b* remain in place, but could have been removed to allow venting of the propellant gas earlier in the firing sequence. With diaphragm 40 and projectile 41 loaded into the gun and launch tube 13 screwed back into connecting block 12, the sequence of events leading to expulsion of the projectile from the gun appears in FIGS. 3A through 3F (in what follows, identifying numbers refer back to FIG. 1 and/or FIG. 2).

Figures 3A, 3B, 3C:
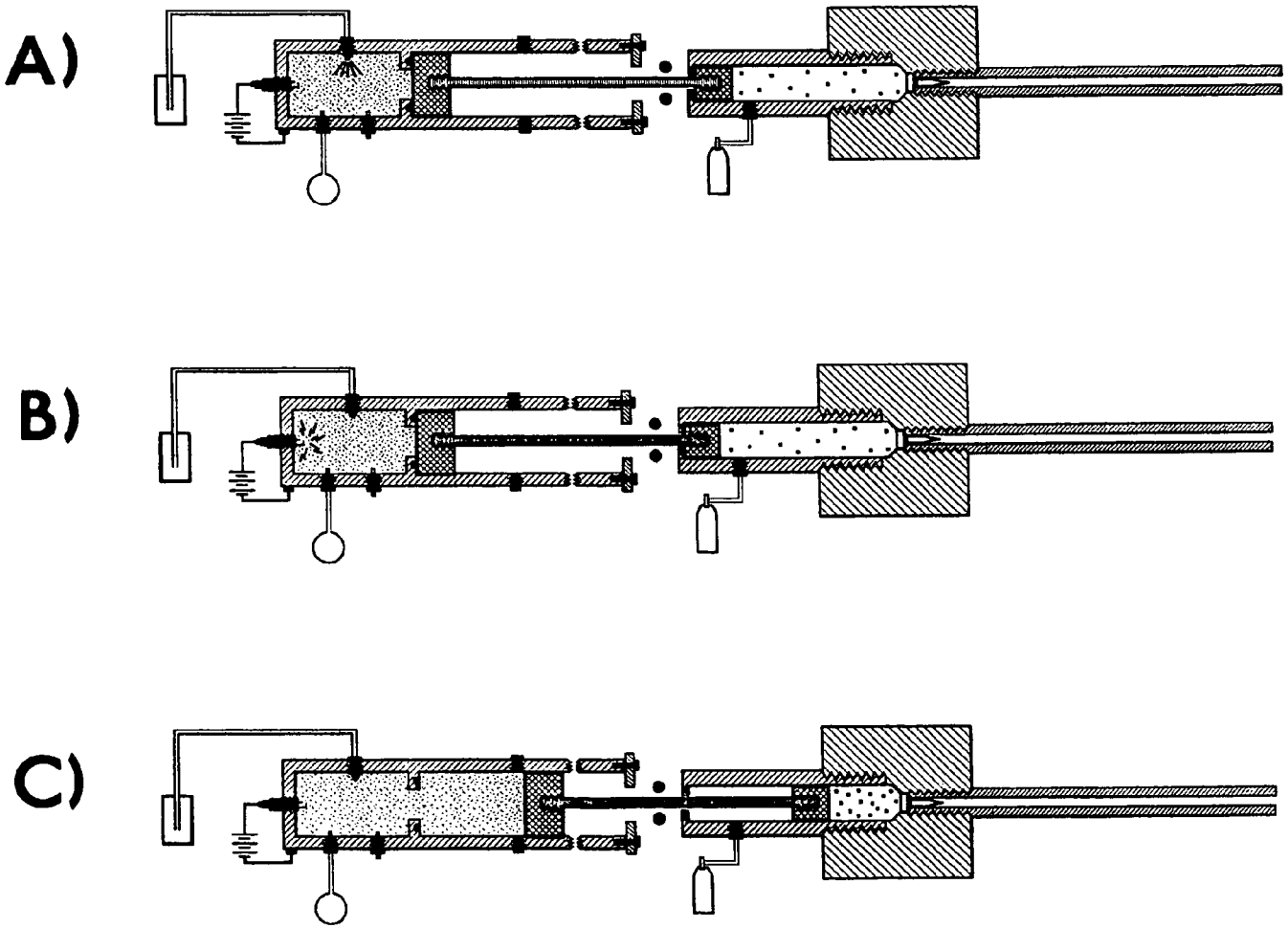
FIGS. 3A-3F depict the steps involved in firing the two-stage light gas gun of the preferred embodiment of the invention.

In FIG. 3A, either hydrogen or helium gas has been supplied under pressure from tank 38, through high-pressure line 37 and one-way valve 36 into cavity 39 of pump tube 11. The stippling within cavity 39 indicates the presence of the hydrogen or helium gas. The pressure of the gas within cavity 39 pushes upon pump piston 26, forcing it against end cap 34. O-ring 35, being squeezed between pump piston 26 and end cap 34, forms a tight seal that prevents the pressurized gas from leaking out of pump tube 11. The pressure exerted upon pump piston 26 by the pressurized gas in cavity 39 is also partially exerted upon expansion piston 25 by way of connecting rod 27. The resulting force acting upon expansion piston 25 squeezes o-ring 28 up against shoulder 14, forming a tight seal. In order to ensure that adequate force is applied to both o-ring seals 28 and 35, the distance between pump piston 26 and expansion piston 25 may be adjusted by screwing connecting rod 27 further into, or out of, either piston individually.

Continuing with FIG. 3A, combustion chamber 15 has been pressurized with air or other oxidizing gas via pressurized tank 17 and one-way valve 16, immediately after which liquid fuel, such as alcohol, is supplied from fuel tank 19, through fuel line 20, and injected by fuel injector 18 into combustion chamber 15. The stippling within combustion chamber 15 depicts the resulting fuel/air, or more broadly, the fuel/oxidizer, mixture. The pre-ignition pressure within combustion chamber 15 is held sufficiently lower than the pressure within pump tube 11 so that expansion piston 25 is held tightly against shoulder 14 and o-ring 28. To illustrate this principle, suppose the pressure of the light gas within pump tube 11 is 1,000 pounds per square inch. If the area of expansion piston 25 that is exposed to the fuel/air mixture is equal to the area of pump piston 26 that is exposed to the high-pressure light gas within cavity 39, then a pre-ignition fuel/air pressure of 250 pounds per square inch results in a force on the left face of expansion piston 25 that is one-fourth as large as the force pushing on the right face of pump piston 26. As long as the larger force exerted through pump piston 26 is properly distributed by connecting rod 27, both pistons will be firmly pressed up against their adjacent o-rings, i.e., o-rings 28 and 35.

FIG. 3B depicts ignition of the fuel-air mixture by means of spark plug 21. Combustion of the fuel/air mixture greatly increases the pressure within combustion chamber 15 so that the force pushing expansion piston 25 to the right is considerably greater than the force pushing pump piston 26 to the left. In FIG. 3C both pistons, along with connecting rod 27 joining them, have moved in unison to the right. After expansion piston 25 separated from shoulder 14 a much greater surface area of expansion piston 25 was exposed to the hot combustion gases, which in turn greatly increased the force pushing expansion piston 25 to the right. In FIG. 3C the light gas within cavity 39 of pump tube 11 has been considerably compressed from its initial volume.

Figures 3D, 3E, 3F:
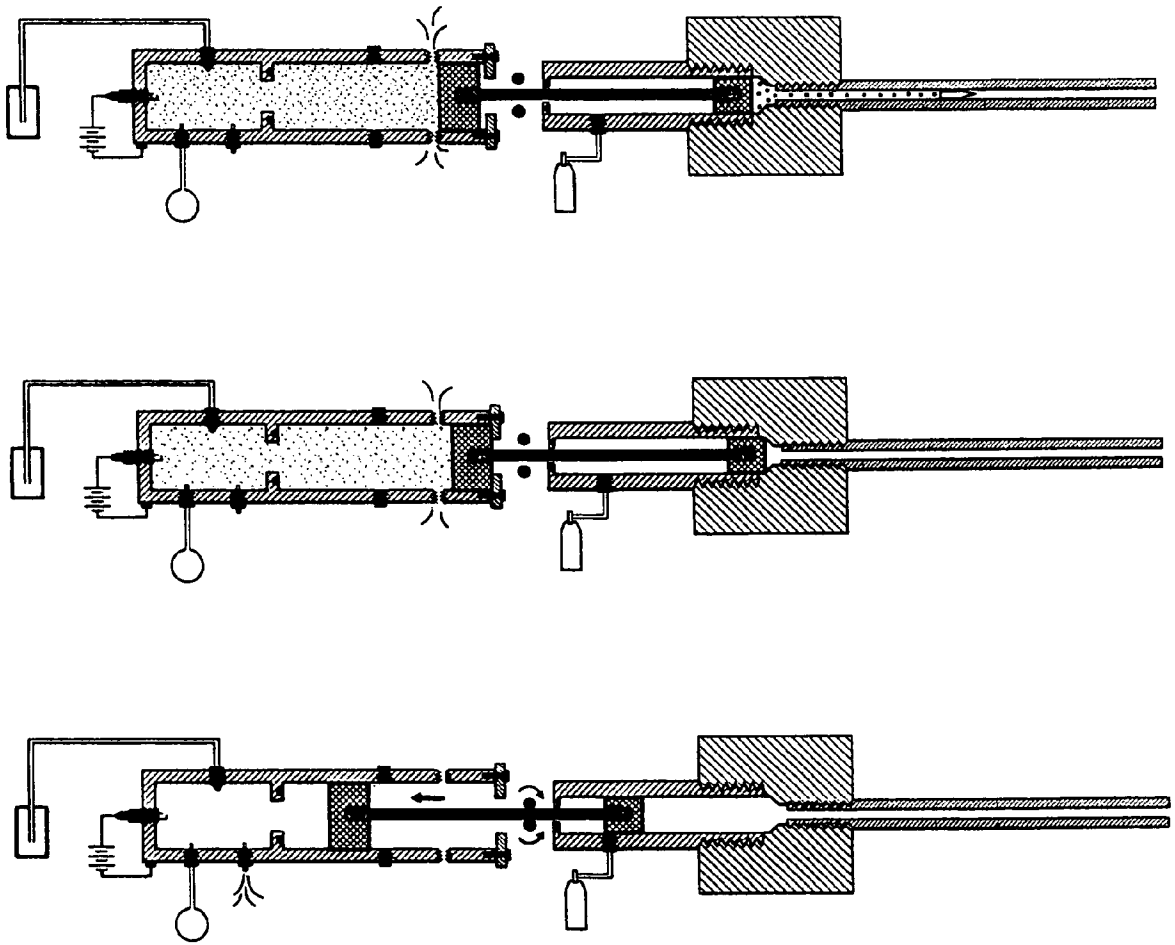

In FIG. 3D expansion piston 25 has moved past the second set of plugs, 30*t* and 30*b*, but not yet met end-stops 31*t* and 31*b*. The force due to the combustion gas has fallen dramatically, partly because energy has been extracted from it, and partly because the gas is being vented through the open plugs. Also in FIG. 3D diaphragm 40 has been breached and the hot, high-pressure light gas is shown accelerating projectile 41 down launch tube 13. Even though the light gas is now at a much higher pressure than the combustion gas in expansion tube 10, the piston/connecting rod structure continues to move to the right due to its momentum. Only when expansion piston 25 has impacted end-stops 31*t* and 31*b* does the entire piston/connecting rod structure come to a halt, as shown in FIG. 3E. Note also in FIG. 3E that projectile 41 has completely exited launch tube 13, and that the combustion gas and light gas have both been largely dissipated, as indicated in expansion tube 10 by the reduced amount of stippling within it, and in launch tube 13 by the complete absence of any stippling.

FIG. 3F shows the piston/connecting rod structure returning to its original start position depicted in FIG. 3A via the impetus supplied by return rollers 33*t* and 33*b*. Valve 24 has been manually opened to allow the venting of residual propellant gas trapped by the return of expansion piston 25 to its position adjacent to shoulder 14. Valve 24 is then closed, and the process of readying the gun for launching another projectile is repeated as described at the beginning of this section.

Figure 4:
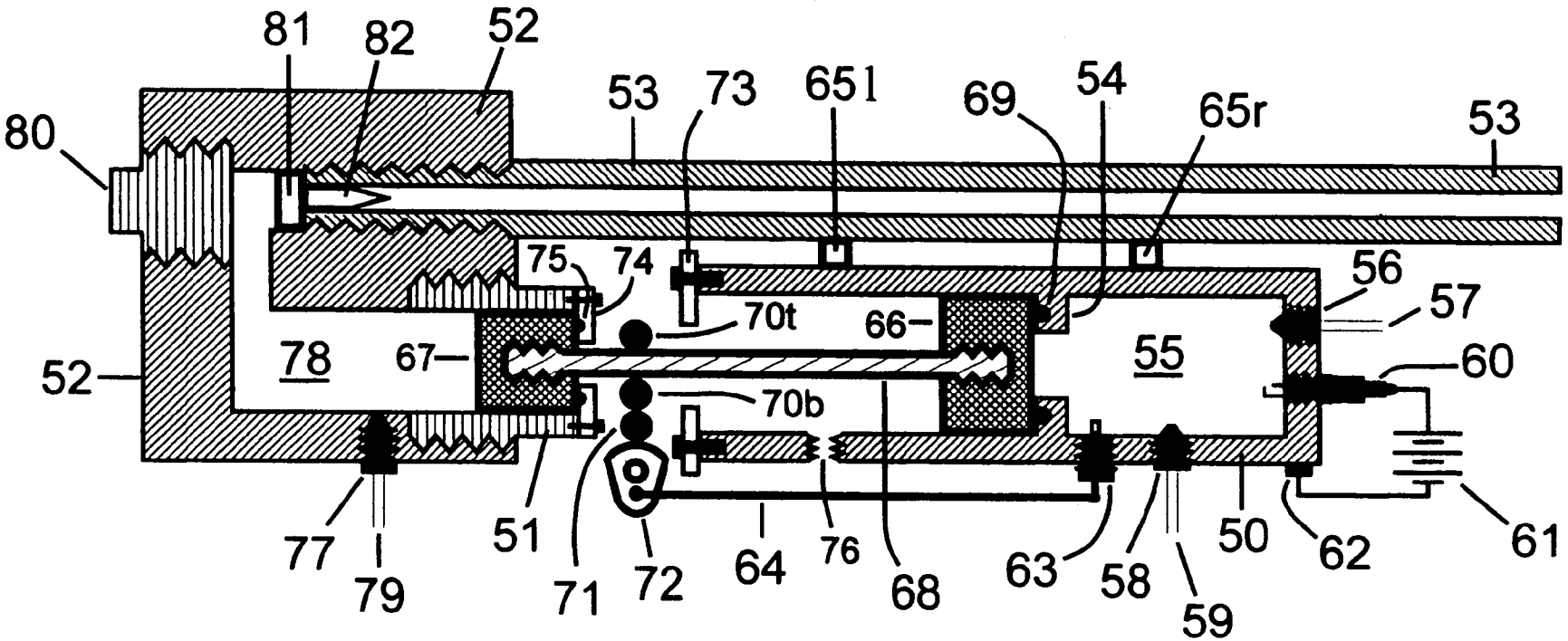
FIG. 4 shows a lateral cross-sectional view of an alternative embodiment of a two-stage light gas gun constructed in accordance with the present invention.

FIG. 4—First Alternative Embodiment

Figure 6:
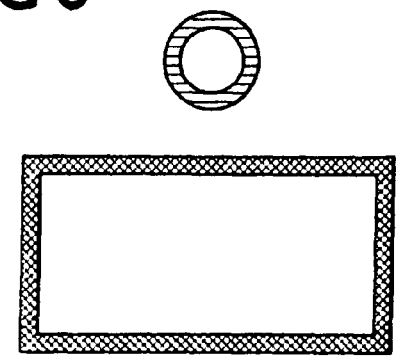
FIG. 6 shows a cross-sectional, muzzle-end view of the expansion tube and launch tube of the alternative embodiment of FIG. 4.

An alternative embodiment of the present invention is shown in FIG. 4. Like the preferred embodiment, the two-stage light gas gun shown in FIG. 4 can be conveniently divided into the four sections of expansion tube 50, pump tube 51, connecting block 52, and launch tube 53. However, in the preferred embodiment shown in FIG. 1 those four components—the expansion tube 10, pump tube 11, and launch tube 13, as well as the connecting block 12—are laid out linearly (that is, they share a common axis); by contrast, in the alternative embodiment of FIG. 4, the expansion tube 50 and pump tube 51 lie beneath launch tube 53. It is noted that while pump tube 51 and launch tube 53 possess a cylindrical shape, expansion tube 50 has a rectangular shape, as depicted in the muzzle-end-view perspective of FIG. 6 (only launch tube 53 and expansion tube 50 appear in FIG. 6).

Shoulder 54 near the middle of expansion tube 50 helps define combustion chamber 55. One-way valve 56 allows an oxidizing gas to flow into combustion chamber 55 but not back out. The oxidizing gas is supplied through high pressure line 57.

Fuel injector 58 is supplied by fuel line 59, which may be of either rigid or flexible construction. Spark plug 60 is connected to power supply 61, which is grounded to expansion tube 50 by metallic bolt 62. Valve 63 acts as a pressure relief valve opening automatically if the pressure inside combustion chamber 55 exceeds a predetermined safe value; valve 63 can also be opened by movement of linkage 64.

Expansion tube 50 and launch tube 53 are rigidly attached to each other by connectors 65*l* and 65*r* ("l" stands for left, and "r" for right). Within expansion tube 50 is expansion piston 66, which is connected to smaller pump piston 67 within pump tube 51 by connecting rod 68. On the piston side of shoulder 54 is o-ring 69. Situated between expansion tube 50 and pump tube 51 are return rollers 70*t* and 70*b* ("t" stands for top, and "b" for bottom). Idler sprocket 71 and rocker arm 72 are situated beneath return rollers 70*t* and 70*b*. At one end of expansion tube 50, opposite combustion chamber 55, is end-stop 73. Between end-stop 73 and expansion piston 66 is exhaust port 76, which is threaded.

At the one end of pump tube 51 is end cap 74, the inside face of which holds o-ring 75. One-way valve 77 allows a light gas to flow into cavity 78 that is defined by pump tube 51 and connecting block 52. High pressure line 79 supplies a light gas to one-way valve 77.

Screw-type breach block 80 is screwed into connecting block 52. Connecting block 52 holds diaphragm 81. Projectile 82 lies within launch tube 53 and adjacent to diaphragm 81.

Operation of First Alternative Embodiment

FIGS. 4, 5A-5E

The description of the operation of the alternative embodiment will be more concise than for the preferred embodiment since the operation of the two is very similar. The sequence of events leading to expulsion of the projectile from the gun appears in FIGS. 5A through 5E; reference numbers refer back to FIG. 4.

Figure 5A:
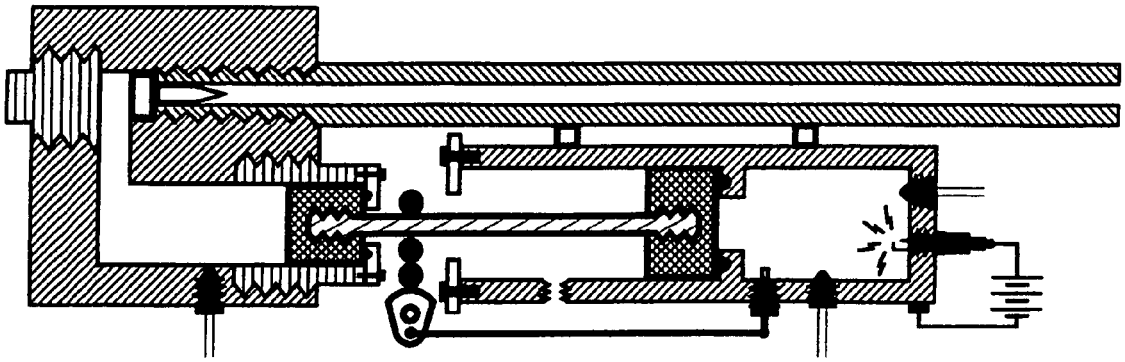
FIGS. 5A-5E depict the steps involved in firing the two-stage light gas gun of the alternative embodiment of the invention shown in FIG. 4.

Operation of the alternative embodiment begins with unscrewing breach block 80 from connecting block 52, followed by loading projectile 82 into the breach-end of launch tube 53, with diaphragm 81 then placed behind, and in contact with, projectile 82. In FIG. 5A, either hydrogen or helium gas has been supplied under pressure into cavity 78 via one-way valve 77. The pressure of the gas within cavity 78 pushes upon pump piston 67, forcing it against end cap 74. O-ring 75, being squeezed between pump piston 67 and end cap 74, forms a tight seal that prevents the pressurized gas from leaking out of cavity 78. The pressure exerted upon pump piston 67 by the pressurized gas in cavity 78 is also exerted upon expansion piston 66 by way of connecting rod 68. The resulting force upon expansion piston 66 squeezes o-ring 69 up against shoulder 54, forming a tight seal.

Continuing with FIG. 5A, combustion chamber 55 has been pressurized with an oxidizing gas via one-way valve 56, and injected with liquid fuel via fuel injector 58. Ignition of the fuel/air mixture by means of spark plug 60 is depicted by the squiggly lines appearing in FIG. 5A.

Figure 5B:
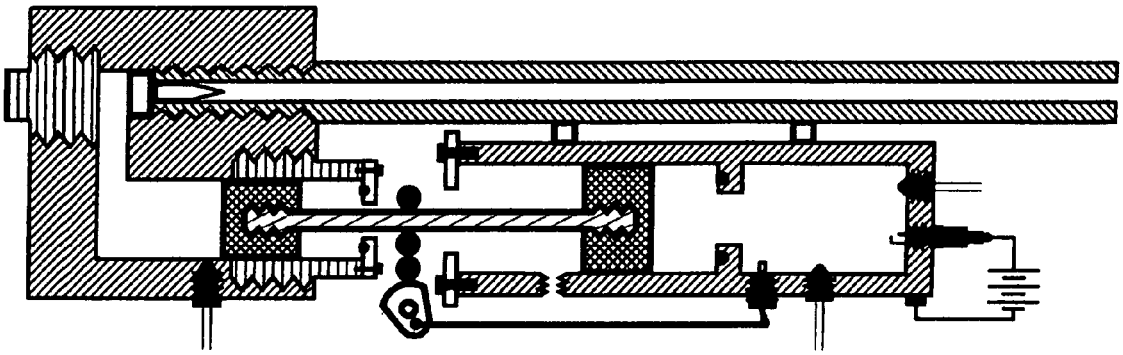

In FIG. 5B both pistons, along with connecting rod 68 joining them, have moved in unison to the left in response to the combustion of the fuel/air mixture originally confined in combustion chamber 55. Movement to the left of connecting rod 68 rotates return rollers 70*t* clockwise and 70*b* counterclockwise, winding torsion springs affixed to each. Idler sprocket 71 is engaged by return roller 70*b*, which in turn rotates rocker arm 72 counterclockwise, thereby shifting linkage 64 to the right. Linkage 64 pushes a lever on valve 63, but not to the point where valve 63 is yet open.

Figure 5C:
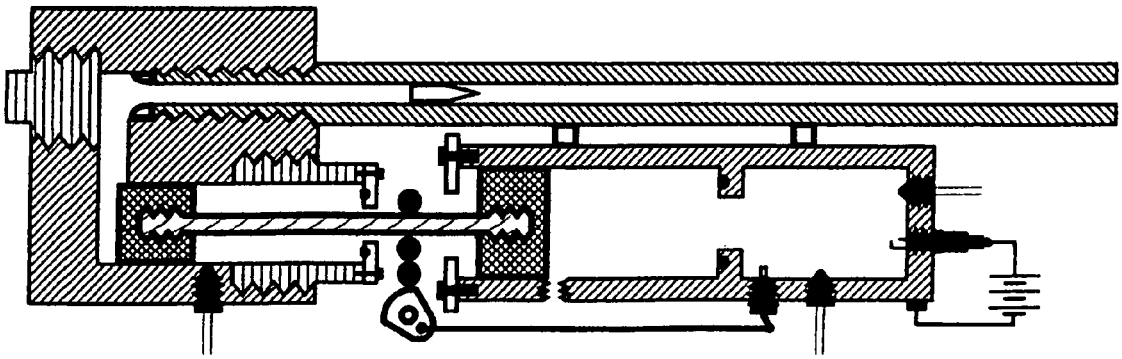
Figure 5D:
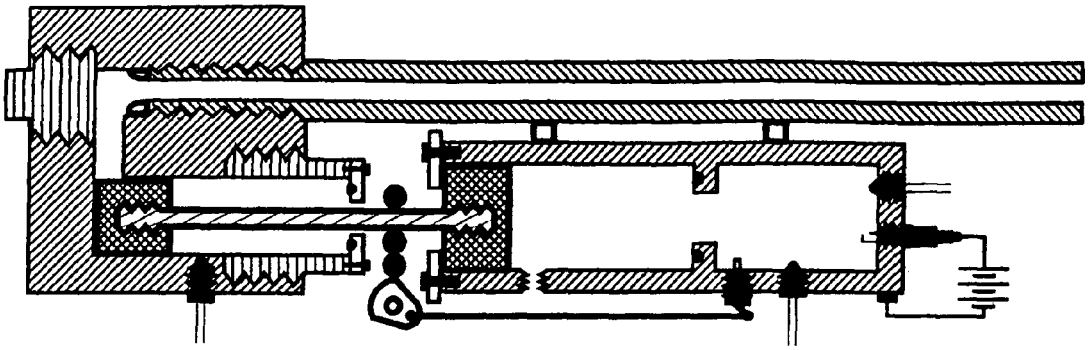

In FIG. 5C movement of expansion piston 66 has exposed port 76, allowing hot combustion gases to vent from expansion tube 50. Moreover, rocker arm 72 has rotated further counterclockwise, shifting linkage 64 further to the right which opens valve 63, thereby venting additional hot combustion gases from expansion tube 50. Also in FIG. 5C diaphragm 81 has been breached and the hot, high-pressure light gas has pushed projectile 82 partway down launch tube 53. Even though the light gas is at a higher pressure than the combustion gas in expansion tube 50, the piston/connecting rod structure continues to move to the left due to its momentum. Only when expansion piston 66 has impacted end-stop 73 does the entire piston/connecting rod structure come to a halt, as shown in FIG. 5D. Note also in FIG. 5D that projectile 82 has completely exited launch tube 53.

Figure 5E:
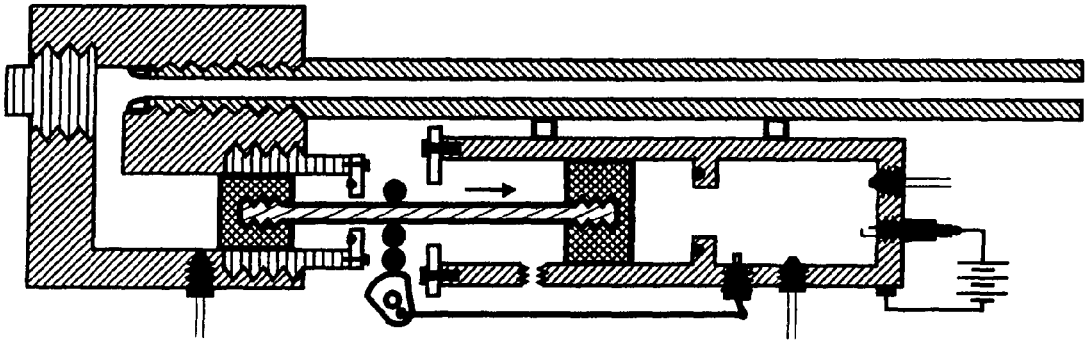

FIG. 5E shows return of the piston/connecting rod structure mid-way towards its original start position of FIG. 5A by return rollers 70*t* and 70*b* via the force applied by their embedded torsion springs. As expansion piston 66 reaches shoulder 54, valve 63 is closed; then the process of readying the gun for launching another projectile can be repeated as described at the beginning of this section, with the caveat that once breach block 80 is unscrewed from connecting block 52, the spent diaphragm is removed before the loading of a new diaphragm 81 and projectile 82 can commence.

Figure 8:
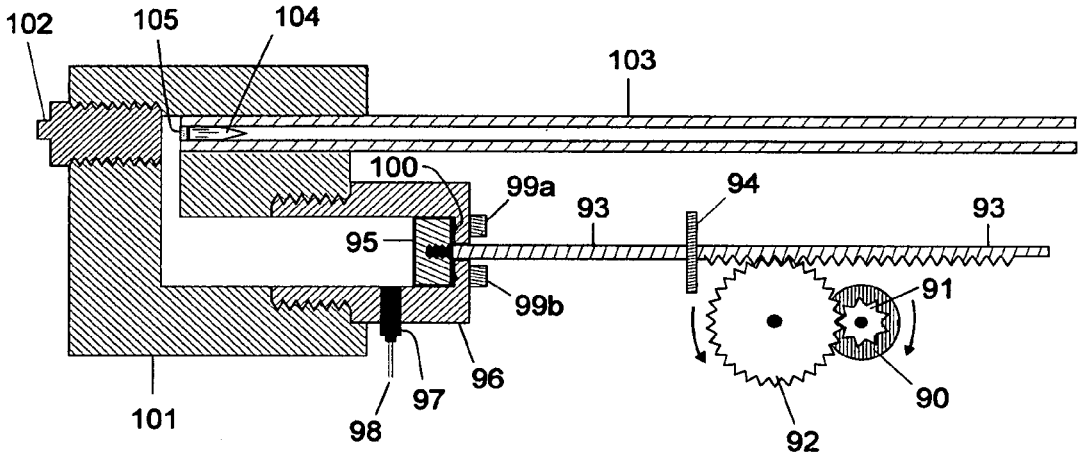
FIG. 8 shows a lateral cross-sectional view of an alternative embodiment of the invention.

FIG. 8—Second Alternative Embodiment

The second alternative embodiment of the invention, shown in FIG. 8, is quite similar to the first alternative embodiment shown in FIG. 4, so the description of its parts and its operation will be abbreviated. The principle difference between the first and second alternative embodiments is that expansion tube 50 shown in FIG. 4 has been eliminated. In place of an expansion tube, and the many ancillary components associated with it, there is electric motor 90, small gear 91, and large gear 92.

In contact with large gear 92 is toothed rod 93, near the middle of which is bar stop 94. Attached to the threaded end of toothed rod 93 is pump piston 95, which lies within pump tube 96. One-way valve 97, which is supplied through high-pressure line 98, is attached to pump tube 96, as are end stops 99*a* and 99*b* ("a" stands for "above", while "b" stands for "below"). Affixed to pump piston 95, and squeezed between pump tube 96 and pump piston 95, is o-ring 100. Both pump tube 96 and screw-type breach block 102 are threaded into connecting block 101. Launch tube 103 contains projectile 104 and diaphragm 105.

The operation of the two-stage light gas gun depicted in FIG. 8 is as follows: first, screw-type breach block 102 is unscrewed and projectile 104 is loaded into launch tube 103, followed by diaphragm 105. Screw-type breach block 102 is then replaced. Light gas is subsequently directed from high pressure line 98, through one-way valve 97, and into pump tube 96 until the gas pressure reaches a predetermined level. The light gas cannot escape past pump piston 95 due to the compression seal of o-ring 100.

Electric motor 90 then spins smaller gear 91 clockwise, causing the counterclockwise rotation of larger gear 92, which in turn engages the teeth of toothed rod 93, pushing toothed rod 93 and attached pump piston 95 down pump tube 96 in the direction of screw-type breach block 102. Movement of pump piston 95 down pump tube 96 compresses the light gas introduced through one-way valve 97, until sufficient pressure is attained, rupturing diaphragm 105, and propelling projectile 104 down and out of launch tube 103.

After diaphragm 105 ruptures, power to electric motor 90 is shut off; however, pump piston 95 continues to compress the light gas for a short period of time due to its own momentum, along with the combined momentum of attached toothed rod 93, and gears 91 and 92, and electric motor 90. Forward motion of pump piston 95 and toothed rod 93 is finally halted by pressure of the light gas pushing on pump piston 95, as well as by the impact of bar stop 94 with end stops 99*a* and 99*b*.

The slow reversal of electric motor 90 reverses the rotation of gears 91 and 92, which retracts toothed rod 93 and pump piston 95 until o-ring 100 is again compressed. A new firing cycle can then commence with opening of screw-type breach block 102 as described previously, with the single caveat that the previously-used diaphragm 105 is discarded before the loading of a new projectile 104 and new diaphragm 105.

Figure 9:
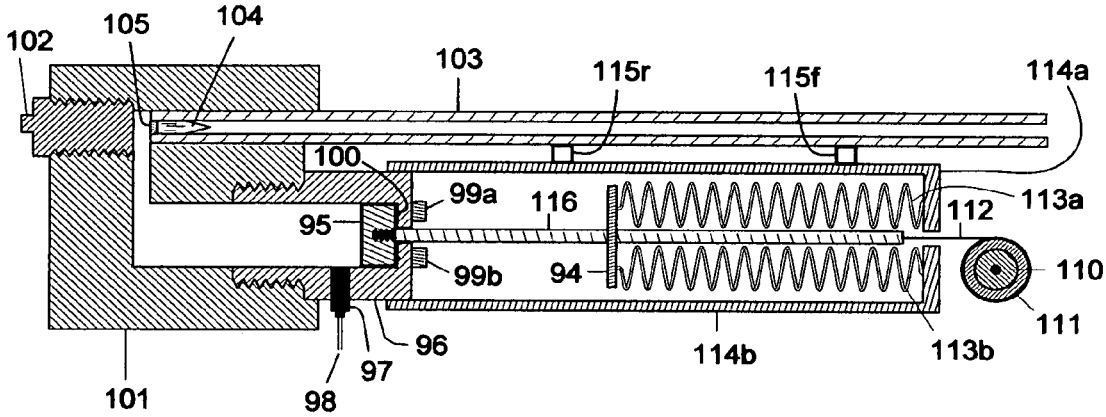
FIG. 9 shows a lateral cross-sectional view of an alternative embodiment of the invention.

FIG. 9—Third Alternative Embodiment

This embodiment of the invention, depicted in FIG. 9, is very similar to the second alternative embodiment shown in FIG. 8. What differentiates the two embodiments is that electric motor 90, small gear 91, large gear 92, and toothed rod 93 have been replaced with a new set a parts; otherwise, the components of the two embodiments are identical. That new set of parts consists of electric motor 110, pulley 111, cable 112, smooth rod 116, compression springs 113*a* and 113*b* ("a" stands for "above" and "b" stands for "below"), brackets 114*a* and 114*b*, and connectors 115*r* and 115*f* ("r" stands for "rear" and "f" stands for "front"). For the parts of the two embodiments that are identical, their corresponding reference numbers are the same in FIGS. 8 and 9.

Compression springs 113*a* and 113*b* are affixed at one end to brackets 114*a* and 114*b*, and at the other end to bar stop 94. Brackets 114*a* and 114*b* are each connected at one end to pump tube 96. Connectors 115*r* and 115*f* support launch tube 103 by rigidly connecting launch tube 103 to bracket 114*a*.

The operation of the third alternative embodiment shown in FIG. 9 in terms of loading and firing the gun is exactly the same as the operation of the second alternative embodiment shown in FIG. 8, with the exception of how pump piston 95 is propelled down pump tube 96 to compress the light gas.

In the third alternative embodiment shown in FIG. 9, after projectile 104 and diaphragm 105 are loaded and the light gas is introduced into the gun, all in the manner described previously for the second alternative embodiment, the gun is ready to be fired. Initially, pulley 111 is prevented from rotating, which keeps sufficient tension on cable 112 such that compression springs 113*a* and 113*b* cannot expand and push upon bar stop 94. The gun is fired when pulley 111 is released, allowing it to freely rotate and release cable 112; thereafter, compression springs 113*a* and 113*b* push upon bar stop 94, which in turn pushes upon and accelerates both smooth rod 116 and pump piston 95. Compression of the light gas by pump piston 95 bursts diaphragm 105, propelling projectile 104 down launch tube 103 in exactly the same manner as described previously for the second alternative embodiment.

The movement of smooth rod 116 is halted by attached bar stop 94 when the later impacts end stops 99*a* and 99*b*. The gun is readied for another firing by first powering up electric motor 110, which rotates pulley 111 and rolls up cable 112 onto pulley 111. Winching cable 112 onto pulley 111 squeezes compression springs 113*a* and 113*b* until pump piston 95 meets the closed end of pump tube 96, squeezing o-ring 100. The spent diaphragm 105 is removed, and a new projectile 104 and diaphragm 105 are put into place; subsequently, a new charge of light gas is introduced into the gun, as per the description of operation for the second alternative embodiment given previously.

Figure 10:
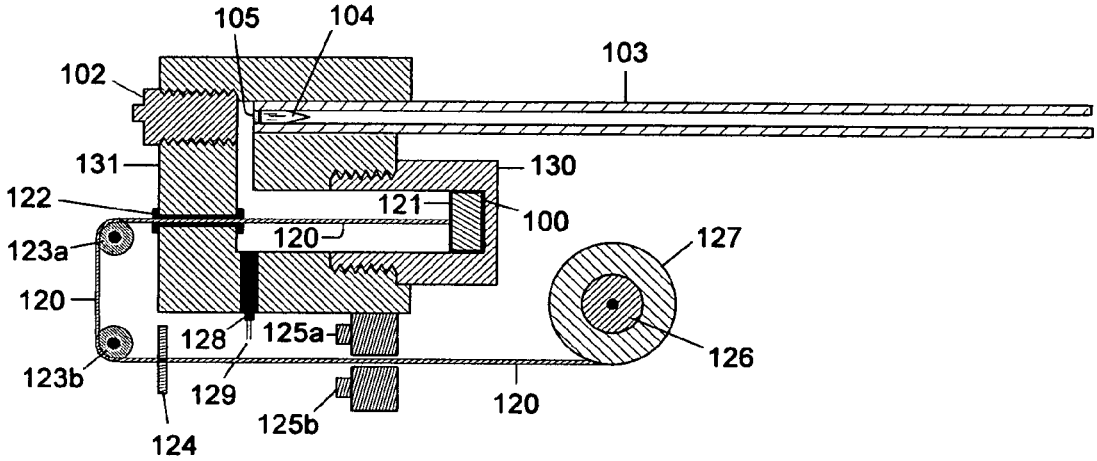
FIG. 10 shows a lateral cross-sectional view of an alternative embodiment of the invention.

FIG. 10—Fourth Alternative Embodiment

Yet another alternative embodiment of the present invention is depicted in FIG. 10. While having several parts in common with the second and third alternative embodiments, the fourth alternative embodiment of the invention is unique in that the pump piston is actuated via a cable instead of a rigid rod.

The parts differentiating this fourth alternative embodiment, as depicted in FIG. 10, from the third alternative embodiment consist of: cable 120, which is affixed at one end to pump piston 121, and which passes through cable sleeve 122, over upper pulley 123*a* and around lower pulley 123*b*, past end stops 125*a* and 125*b*, and terminating at its other end on flywheel 127. Electric motor 126 shares a common axle with flywheel 127; cable stop 124 is firmly affixed to cable 120 and lies between lower pulley 123*b* and end stops 125*a* and 125*b*. One-way valve 128, which is supplied through high-pressure line 129, is affixed to connecting block 131 and is situated close to cable sleeve 122. Pump tube 130 is threaded into connecting block 131.

The operation of the fourth alternative embodiment, in terms of loading and firing the gun, follows much the same procedure as the operation of the second and third alternative embodiments shown in FIGS. 8 and 9, respectively; however, pump piston 121 is propelled down pump tube 130 by the action of a cable, instead of a rod which is utilized in all previous embodiments of the invention.

For the fourth alternative embodiment, shown in FIG. 10, after projectile 104 and diaphragm 105 are loaded and the light gas is introduced into the gun from high-pressure line 129 and through one-way valve 128, all in the manner described previously for the second and third alternative embodiments, the gun is ready to be fired. Electric motor 126 first spins up flywheel 127. When flywheel 127 attains a predetermined rpm it engages cable 120. As flywheel 127 rotates, it wraps up cable 120. Cable 120 is pulled over lower pulley 123*b* and upper pulley 123*a*, through cable sleeve 122 and through pump tube 130, where it transmits a force to pump piston 121 to which cable 120 is affixed. Cable sleeve 122 forms a close fit with cable 120 and connecting block 101 such that the light gas is prevented from leaking past cable 120 as it slides through cable sleeve 122. Pump piston 121 is accelerated by cable 120 down pump tube 130, compressing the light gas to a pressure sufficient to burst diaphragm 105. The movement of cable 120 is halted when affixed cable stop 124 meets end stops 125*a* and 125*b*.

The gun is readied for a subsequent firing by opening screw-type breach block 102, removing the spent diaphragm 105, and loading new projectile 104 and diaphragm 105. After screw-type breach block 102 is replaced and tightened, a new charge of light gas is supplied through one-way valve 128 via high-pressure line 129. The pressurized light gas pushes pump piston 121 back to the closed end of pump tube 130 where it seats against o-ring 100.

Additional Embodiments

The screw-type breech block 80 shown in FIG. 4 can be replaced by a more conventional sliding-type breech block, thus significantly reducing the time required to reload the gun.

In FIGS. 4 and 8 the diaphragms 81 and 99, respectively, are valves that can be used only once and then they must be replaced. Each diaphragm can be replaced with a quick-opening valve that can be used in repeated gun firings without the need to be replaced.

Figure 7:
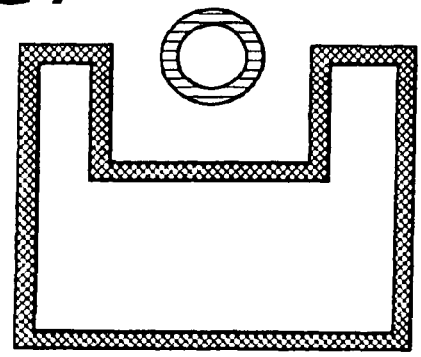
FIG. 7 shows a cross-sectional, muzzle-end view of an expansion tube and launch tube; the expansion tube cross-section is an alternative to the embodiment of FIG. 4.

A further additional embodiment relates to the preferred embodiment of FIG. 1, wherein the expansion tube is considered to be cylindrical. However, the expansion tube in the alternative embodiment of FIG. 4 has a transverse cross-section that is rectangular, as depicted in the end-view perspective of FIG. 6, which shows the muzzle-end of the launch tube as well as the corresponding end of the expansion tube. Obviously, many other cross-sectional shapes are possible for the expansion tube; one alternative shape of an expansion tube is shown (along with the launch tube) in the end-view perspective of FIG. 7.

An anti-recoil mechanism is described which acts to counteract recoil when the gun is fired. For the preferred embodiment of FIG. 1, ports 30*t* and 30*b* can be fitted with tubes bent at right-angles so that spent propellant gas is vented in the opposite direction of the projectile motion. The same sort of anti-recoil tube can be fitted to port 76 in the alternative embodiment shown in FIG. 4.

ADVANTAGES

From the description provided previously, a number of advantages of my two-stage light gas gun become evident:

(a) After the gun is fired, the pump piston can quickly be returned to its start position for another firing.

(b) Any possible residue from the gas that propels the pump piston is prevented from contaminating either the pump tube or the launch tube.

(c) Spent propellant gas is quickly and automatically vented.

(d) The pump piston can be reliably halted at a predetermined position within the pump tube; hence the pump piston can be made of a non-deformable material, such as aluminum or steel, which facilitates long piston life, but without the danger that it could ram into the end of the pump tube and damage the gun.

(e) The piston area that the propellant gas expands against can be greater than, equal to, or less than, the piston area compressing the light gas; the variety of possible ratios of propellant area to compression area means that the invention can be adapted to efficiently meet the requirements of a particular role.

(f) Making the piston area that the propellant gas expands against several times greater than the piston area compressing the light gas allows for the use of much cheaper propellants, such as an alcohol/air mixture, in place of a more-conventional, and expensive, modern gunpowder, while still allowing the pump tube to be much shorter than the launch tube.

(g) In an alternative embodiment of the invention, a projectile can be loaded into the gun via a conventional breech block, thus greatly reducing the time required to reload the gun as compared with two-stage light gas gun design seen in the prior art.

(h) Propellant gases expelled from the expansion tube can be used to counteract the recoil due to firing the gun.

(i) My design for a two-stage light gas gun can be effectively applied to a variety of roles:
laboratory research, anti-armor, artillery, high altitude intercept, and space launches.

CONCLUSION, RAMIFICATIONS, AND SCOPE OF THE INVENTION

It should thus be apparent to the reader that the improved two-stage light gas gun of the invention provides, as compared to previous designs appearing in the prior art, a reliable and compact gun that can sustain a high rate of fire, while also being capable of operating with an inexpensive propellant. In addition, the invention has the following distinct advantages in regards to previous embodiments of two-stage light gas guns:

- the pump piston can quickly be returned to its start position for another firing;
- it can quickly be reloaded with a new projectile after it has been fired;
- it prevents any possible residue from the propellant contaminating the pump tube;
- the propellant is quickly and automatically vented without the need for valves;
- it provides a variety of possible ratios, from less than one, to equal to one, to greater than one, of the area of the piston the propellant pushes against versus the area of the pump piston compressing the light gas;
- it performs well in a variety of roles: laboratory research, anti-armor, very long-range artillery, and shots into outer space;
- the pump piston can be halted reliably at a predetermined position within the pump tube;
- the spent propellant gas can be used to counteract the recoil of the gun;

the projectile can be loaded into the gun via a conventional breech block.

The invention has the additional positive features of providing for a pump tube that is considerably shorter than the launch tube, as well as preventing deformation of the pump piston as a normal part of the firing cycle.

Although several embodiments of the present invention, along with many of its advantages, have been described above in detail, it should be understood that various alterations, modifications, and alternate constructions can be made herein without departing from the spirit and scope of the invention as defined by and within the appended claims. Indeed, the scope of the present application is not intended to be limited to the particular embodiments of the machine, manufacture, composition of matter, means, methods, and steps described in the specification. Instead, it will be understood by those of ordinary skill in the art that various changes in form and details may be made therein without departing from the scope of the present invention as defined in the appended claims.

I claim:

1. In a two-stage light gas gun comprised of a pump tube containing both a gas and a pump piston for compressing said gas, said pump tube connected to a launch tube, said launch tube containing a projectile, with a valve preventing the flow of said gas from said pump tube into said launch tube until said pump piston has sufficiently compressed said gas, wherein the improvement consists of:

a) an expansion piston contained within an expansion tube, said expansion piston constrained to move longitudinally within said expansion tube, b) a piston rod rigidly connected to said expansion piston at one end and said pump piston at the opposite end, and c) a propellant gas, whereby pressure of said propellant gas causes said expansion piston to move longitudinally within said expansion tube transmitting force through said piston rod to said pump piston causing said pump piston to move longitudinally within said pump tube and compressing said gas to a pressure sufficient to open said valve and pass from said pump tube into said launch tube expelling said projectile from said launch tube, the piston rod is longitudinally coaxially aligned with a central axis of the launch tube during the entirety of the operation of the two-stage light gas gun, wherein a battery with associated spark plug acts to ignite said propellant gas to propel said expansion piston.

2. The two-stage light gas gun of claim 1 wherein said valve is a single-use diaphragm designed to burst open at a predetermined pressure.

3. The two-stage light gas gun of claim 1 wherein said valve is designed to open at a predetermined pressure and can be used repeatedly for multiple things of said gun.

4. The two-stage light gas gun of claim 1 wherein said propellant gas is produced by the combustion of a solid propellant.

5. The two-stage light gas gun of claim 1 wherein said propellant gas is produced by the combustion of a liquid fuel and an oxidizer.

6. The two-stage light gas gun of claim 1 wherein said propellant gas is produced by the combustion of a gaseous fuel and an oxidizer.

7. In a two-stage light gas gun comprised of a pump tube containing both a gas and a pump piston for compressing said gas, said pump tube connected to a launch tube, said launch tube containing a projectile, with a flow prevention device preventing the flow of said gas from said pump tube into said launch tube until said pump piston has sufficiently compressed said gas, wherein the improvement consists of:

a) an expansion tube, b) an expansion piston contained within said expansion tube, said expansion piston constrained to move longitudinally within said expansion tube, and c) a linkage device for connecting said expansion piston to said pump piston; whereby a fluid within said expansion tube exerts force against said expansion piston causing said expansion piston to move longitudinally within said expansion tube, which in combination with said linkage device causes said pump piston to compress said gas to a pressure sufficient to pass from said pump tube into said launch tube expelling said projectile from said launch tube, wherein said linkage device is a piston rod that is longitudinally coaxially aligned with a central axis of the launch tube during the entirety of the operation of the two-stage light as gun, and wherein a battery with associated spark plug acts to ignite said fluid to propel said expansion piston.

8. The two-stage light gas gun of claim 7 wherein said fluid is a gas produced by the combustion of a solid propellant.

9. The two-stage light gas gun of claim 7 wherein said fluid is a gas produced by the combustion of a liquid fuel and an oxidizer.

10. The two-stage light gas gun of claim 7 wherein said fluid is a gas produced by the combustion of a gaseous fuel and an oxidizer.

11. In a two-stage light gas gun comprised of a pump tube containing both a gas and a pump piston for compressing said gas, said pump tube connected to a launch tube, said launch tube containing a projectile, with a flow prevention device preventing the flow of said gas from said pump tube into said launch tube until said pump piston has sufficiently compressed said gas, wherein the improvement consists of:

a) a linkage device connected to said pump piston, and b) an expansion piston for applying force to said linkage device whereby said force applied to said linkage device causes said pump piston to compress said gas, wherein said linkage device is a piston rod that is longitudinally coaxially aligned with a central axis of the launch tube during the entirety of the operation of the two-stage light gas gun, and wherein a battery with associated spark plug acts to ignite a fuel to propel said expansion piston.

12. The two-stage light gas gun of claim 11 wherein an expansion tube contains said expansion piston constrained to move longitudinally within said expansion tube, with said expansion piston connected to said linkage device, and wherein a second gas held within said expansion tube pushes on said expansion piston producing said force.

13. The two-stage light gas gun of claim 11 wherein an expansion tube contains said expansion piston constrained to move longitudinally within said expansion tube, with said expansion piston connected to said linkage device, and wherein a liquid under pressure held within said expansion tube pushes on said expansion piston producing said force.

* * * * *